US005757943A

United States Patent [19]

Arledge, Jr.

[11] Patent Number: 5,757,943

[45] Date of Patent: May 26, 1998

[54] MOVABLE BOOM MOUNTING DEVICE

[76] Inventor: Bruce Arledge, Jr., 6614 Smoketree Ave., Agoura, Calif. 91301

[21] Appl. No.: 735,566

[22] Filed: Oct. 23, 1996

Related U.S. Application Data

[63] Continuation of Ser. No. 275,944, Jul. 14, 1994, abandoned.

[51] Int. Cl.[6] ..... H04R 25/00

[52] U.S. Cl. ..... 381/169; 381/26; 381/188; 381/205; 381/91; 248/298.1

[58] Field of Search ..... 381/168–169, 381/187–188, 205, 26, 91; 248/298.1

[56] References Cited

U.S. PATENT DOCUMENTS

| | | | |
|---|---|---|---|
| 1,975,283 | 10/1934 | Mueller . | |
| 2,053,833 | 9/1936 | Jones . | |
| 2,122,778 | 7/1938 | Mueller | 381/169 |
| 2,421,437 | 6/1947 | Ryan et al. | 381/169 |
| 3,431,585 | 3/1969 | Foltz | 16/94 |
| 4,475,226 | 10/1984 | Greenberg . | |
| 4,699,484 | 10/1987 | Howell et al. . | |
| 4,791,674 | 12/1988 | Drever . | |
| 5,303,304 | 4/1994 | Lee | 381/26 |

OTHER PUBLICATIONS

Umekage Yasuhiro, "Microphone Moving Apparatus"; European Patent Office; Application No.: JP860132293; Application Date: Jun. 6, 1986; Publication No. JP62288532; published 15 Dec. 1987.

Kamal Benjellon, "Moveable Stereo Sound System"; PCT; Application No. PCT/US91/02455; Filing Date: 5 Apr., 1991; Publication No.: WO 91/15420; Publication Date: 17 Oct., 1991.

*Primary Examiner*—Curtis Kuntz
*Assistant Examiner*—Duc Nguyen
*Attorney, Agent, or Firm*—Irell & Manella LLP

[57] ABSTRACT

A microphone boom mounting device has two portions, a track portion and a truck portion which moves along the track. The truck portion has a boom mount suitable for mounting a microphone boom. The movable microphone boom mounting device is mounted above a television or a motion picture production stage in a catwalk located above the stage. The track portion is formed in a "T" shape, and the truck portion has wheels which engage the top and bottom surfaces of the top part of the "T" section of the track. By moving the truck along the track, a microphone boom attached to the boom mount on the truck portion can be moved from side to side above the stage, such that a single microphone mount is all that is required to follow the actors on the stage in different sets on the stage and ensure a high quality sound recording.

23 Claims, 2 Drawing Sheets

MOVABLE BOOM MOUNTING DEVICE

This is a continuation of application(s) Ser. No. 08/275,944 filed Jul. 14, 1994, now abandoned.

FIELD OF THE INVENTION

The present invention relates generally to the field of recording sound on a television or motion picture production set. More particularly, the present invention relates to replacing a plurality of fixed microphone booms with a single microphone boom on a movable device, while maintaining sound recording quality.

BACKGROUND OF THE INVENTION

In the production of television programs, motion picture features or the like, on a set (such as a sound stage), the audio portion of the program or feature is generally recorded by the use of microphones mounted in the catwalks located above the set. Each microphone is disposed at the end of a long pole or extension like structure referred to those skilled in the art as a "microphone boom." Each microphone boom is anchored in the catwalk.

During the recording of a television program or the like, actors participating in the program may typically move across different locations of a set, sometimes virtually across all locations of the set. A typical stage for a television program will have several different sets on one large stage. For example, a stage may have one set for the kitchen in a house, a neighboring set for the living room, another neighboring set for a bedroom, and yet another neighboring set for a bathroom. Viewing the stage from the front, the sets would be arranged to be adjacent to one another from left to right. A typical television stage containing several sets is approximately 80 feet long.

In order to effectively capture the dialog between the actors at the different areas of the set, a plurality of microphone booms are fixedly mounted in the catwalk above predetermined locations of the set. The catwalk is a walkway with railings that is located above the front of the stage. The microphone booms are mounted along the railings of the catwalk. A typical microphone boom pivots on the mount so that the microphone on the end of the boom can be directed down toward the set, just above the actors. Because of the distance between each set, at least one microphone boom is needed for each set, which requires that several microphone booms are used for an entire stage. The use of more than one microphone booms per set maximizes the likelihood that at least one is appropriately positioned at the required location to effectively record sound, no matter where that location is. The microphone booms for the entire stage extend from one end of the stage to the other.

The use of multiple microphone booms, however, dramatically increases the costs of recording the sound for a program or feature. The mounting of microphone booms requires the expertise of an experienced sound engineer. Thus, larger numbers typically result in considerable expense. Moreover, the cost of purchasing or leasing additional microphone boom equipment substantially increases the overall expense for the production of the program or feature. In short, the total cost of recording sound is increased by the number of microphone booms used on the set. Thus, there exists a need to reduce the number of microphone booms typically required while maintaining an acceptable level of sound recording quality.

SUMMARY OF THE INVENTION

The present invention is directed to a movable microphone boom mounting device, which facilitates use of a single or a minimal number of microphone booms, while maintaining a desirable level of sound recording quality. The microphone boom mounting device comprises two portions, a track portion and a truck portion which rides along the track portion. The truck portion comprises a boom mount for mounting a microphone boom. The movable microphone boom mounting device may be mounted above a television or a motion picture production set, in a catwalk located above the set. Lateral and vertical support legs of the movable microphone boom mounting device attach to a railing and a floor of the catwalk, respectively, such that the track portion is secured to the catwalk. The track portion is configured in a "T" shape and extends along the floor of the catwalk.

The truck portion comprises wheels, which flank the horizontal member of the track, contacting the top and bottom surfaces, respectively. The truck portion rides along the track portion from one end of the catwalk to the other end. A screw brake within the truck portion allows it to be locked into place at any desired position along the track.

By sliding the truck along the track, a microphone boom attached to the boom mount on the truck portion can be moved from one end of the track to the other. The track portion has overlapping ends which facilitate the connection of several track pieces into one long track that extends along the entire stage, in the catwalk above the stage, such that a single microphone boom can follow the actors between sets on the stage to enable high quality recording of the sound below, for example dialog or the like.

In accordance with an alternative embodiment of the invention, the boom mount on the truck portion is capable of pivoting to a desired position or angle, and may be locked with a pin into one of several different angles relative to the truck portion. In this manner, the microphone mount may be tilted closer to or away from the set below to facilitate greater ability to position the microphone above the actors on the set below. This is particularly useful when the actors move toward the front of the stage, to a location more directly under the catwalk, where the microphone boom must be tilted down very steeply. Additionally, in the alternative embodiment, covers are provided to enclose the open spaces of the truck portion at the sides where the truck portion slides along the track. Dust and other airborne particles are thus kept out of the wheels underneath the truck portion.

The truck portion also has spacers on the side opposite the screw brake to engage the track during movement to keep the truck portion in an upright position, and also to act as a buffer between the track portion and the side portion of the truck portion when the screw brake is applied.

These as well as other features of the invention will be described in greater detail below.

BRIEF DESCRIPTION OF THE DRAWINGS

A preferred embodiment of the system and method of the present invention is illustrated in and by the following drawings, in which like reference numerals indicate like parts and in which.

DETAILED DESCRIPTION OF THE PREFERRED EMBODIMENTS

Figure 1:
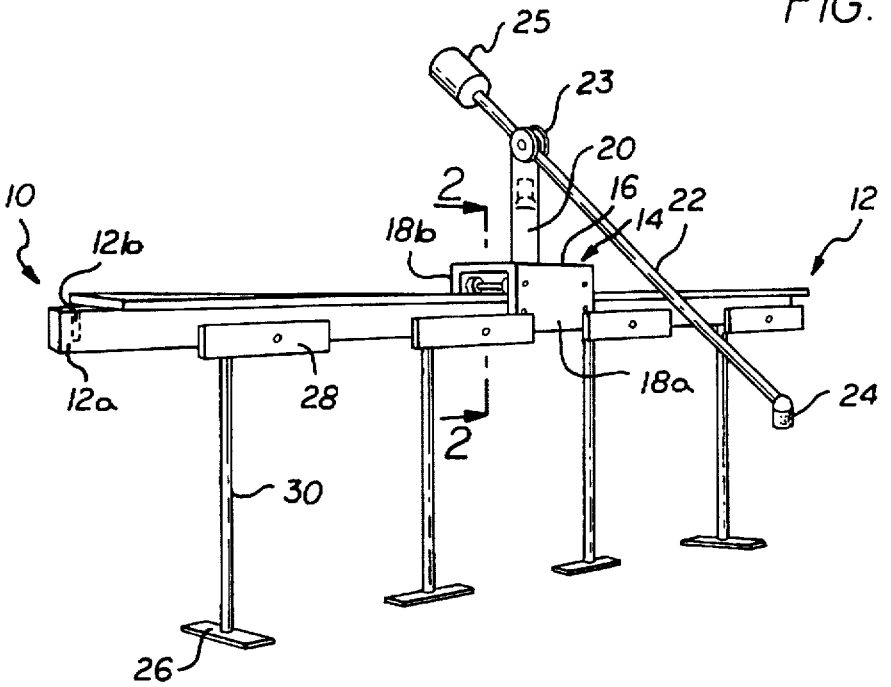
FIG. 1 is a perspective view of the movable boom mounting device.

A movable boom mounting device according to the present invention is shown in the FIG. 1 by the general reference number designation 10. The movable boom mounting device comprises two major portions, a track portion 12 and a truck portion 14. The track portion 12 is an elongated track which supports the truck portion 14. The truck portion 14 slides back and forth along the length of the track portion 12. The truck portion 14 is formed from a top portion 16 and side portions 18*a*, 18*b*. The truck portion also contains a boom mount 20 which is mounted on the top portion 16 of the truck portion 14. The boom mount 20 is constructed to accept a microphone boom 22 having a microphone 24 attached at the end thereto. A typical microphone boom 22 has a pivot 23 mounted above the boom mount to permit the microphone boom 22 to pivot up and down. The microphone boom 22 also has a counterweight portion 25 which balances the weight of the boom on the boom mount 20, to make the microphone boom 22 easier to pivot. The typical microphone boom 22 is telescoping, so that the microphone 24 can be extended further away from the boom mount 20.

The movable boom mounting device 10 is constructed to be located in a catwalk above a television or motion picture production set. The catwalk is located above the front of the stage. The microphone boom 22 is telescoping so that it can be adjusted such that the microphone 24 extends out and away from the movable boom mounting device 10 and is located above the actors on the set below to permit a high quality recording of sound. The pivot 23 on the microphone boom 22 permits the microphone 24 to follow the actors as they walk toward the front of the stage, nearly directly under the catwalk.

In order to facilitate the location of the movable boom mounting device 10 in a catwalk, the track portion 12 is mounted to the catwalk by vertical support plates 26 and by lateral support plates 28. The vertical support plates 26 mount to the floor of the catwalk. The track portion 12 is supported above the vertical support plates 26 by vertical support members 30. The lateral support plates 28 are attached to the front railing of the catwalk (facing the stage) in order to provide lateral support to the track portion 12.

Figure 2:
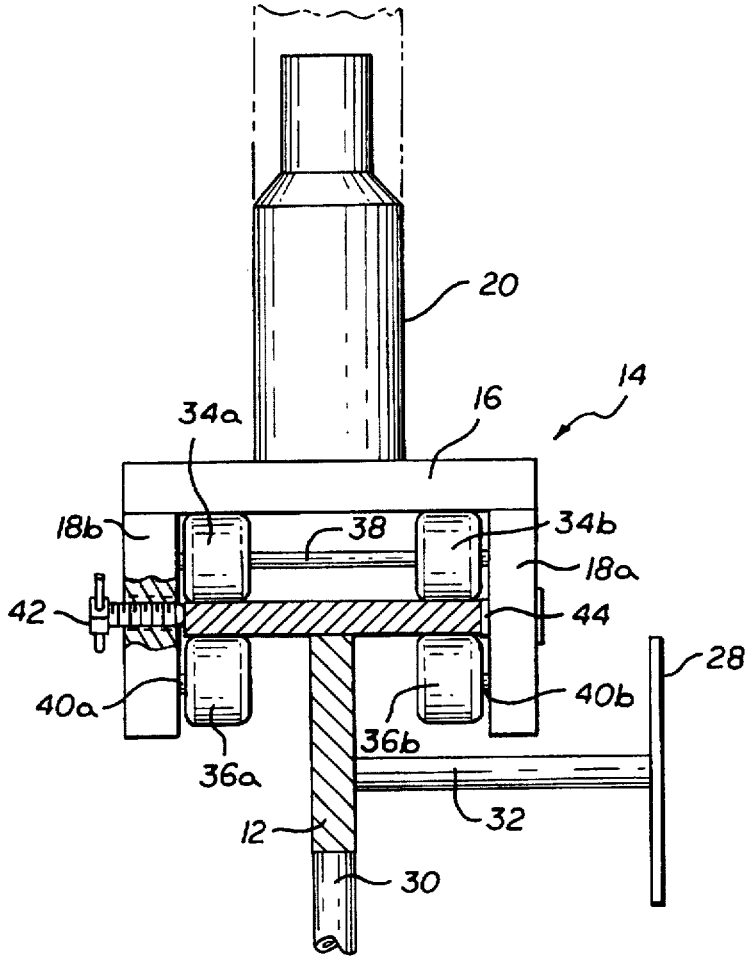
FIG. 2 is a cross-sectional end view of the movable boom mounting device, taken along the line 2—2 of FIG. 1.

FIG. 2 is a cross section view of the movable boom mounting device 10 of FIG. 1 taken along the line 2—2. The cross sectional view of FIG. 2 illustrates the construction of the track portion 12 and the truck portion 14 of the movable boom mounting device 10. The track portion 12 is preferably constructed from two elongated pieces of aluminum which are attached to form a "T" structure. Preferably, the top and lower portions of the track portion 12 are screwed together. The lateral support plate 28 (which is attached to the railing of a catwalk) is connected to the bottom portion of the track portion 12 by a lateral support member 32. The lateral support plate 28 may be attached to the front railing of a catwalk by any suitable means, such as by screws. The lateral support member 32 is attached to the bottom portion of the track portion 12 by any suitable means, but preferably by screws.

As shown in FIG. 1, at one end of the track portion 12, the bottom portion of the track portion 12 extends out and beyond the top portion of the track portion 12, as illustrated at 12*a*. This extended bottom portion 12*a* contains at least one screw hole 12*b*, for receiving a screw that would connect an overlapping top portion of an identical, separate track 12 (shown in FIG. 3, discussed below), to the extended bottom portion 12*a*. In this way, multiple tracks can be connected together along the entire length of a stage, enabling a microphone boom 22 attached to the truck portion 14 to be located at any position on the entire stage.

Referring back to FIG. 2, the truck portion 14 slides along the track portion 12 by the support of top wheels 34*a*, 34*b* and bottom wheels 36*a*, 36*b*. The top wheels 34*a*, 34*b* are mounted underneath the top portion 16 of the truck portion 14, and are attached by an axle 38 which is connected between the side portions 18*a*, 18*b* of the truck portion 14. The top wheels 34*a*, 34*b* are attached such that they ride along the top surface of the track portion 12, thereby supporting the truck portion 14 above the track portion 12 and allowing the truck portion 14 to slide along the top surface of the track portion 12.

Wheel 36*a* is attached to the side portion 18*a* of the truck portion 14 by an axle 40*a*. Wheel 36*b* is attached to the side portion 18*b* of the truck portion 14 by an axle 40*b*. The wheels 36*a*, 36*b* are mounted to the truck portion 14 so that they roll along and engage the bottom surface of the top portion of the track portion 12. The use of both top wheels 34*a*, 34*b* and bottom wheels 36*a*, 36*b* allows the truck portion 14 to slide along the length of the track portion 12 while maintaining a high level of stability. The wheels 34*a*, 34*b* and 36*a*, 36*b* can be constructed out of any suitable material. In the preferred embodiment, the wheels are constructed out of polyurethane and are similar to or identical to wheels used on skateboards.

A portion of the side portion 18*b* is shown cut away in FIG. 2 to illustrate the attachment of a screw brake 42. The screw brake 42 is a screw that is threaded through the side portion 18*b* such that it can be screwed in to engage the side surface of the top portion of the track portion 12. As the screw brake 42 is screwed in to engage the track portion 12, this causes the truck portion 14 to shift laterally across the track portion 12 such that the side portion 18*a* comes into a closer contact with the side surface of the top portion of the track portion 12. At the location where the side portion 18*a* would otherwise engage the track 12, there is a spacer 44 which acts as a buffer between the side portion 18*a* and the track portion 12. The spacer 44 is preferably made of teflon. The spacer 44 has the dual purpose of separating the side portion 18*a* from the track 12 during movement of the truck portion 14 along the track 12, and of engaging the track 12 as the screw brake 42 is screwed in to attach to the track portion 12. As the screw brake 42 is screwed in to attach to the track portion 12, the screw brake 42 and the spacer 44 engage the track 12 with tighter force, thereby locking the truck portion 14 into a desired position along the track 12. During the recording of a performance on the stage below, as the actors move about the stage, the truck portion 14 is moved back and forth along the track portion 12 in order that the microphone 24 may be placed above the immediate location where the actors are located at a given moment. If the actors are to remain in a specified location for any period of time, the screw brake 42 may be utilized to lock the truck portion 14 into place and to prevent it from inadvertently sliding along the track portion 12.

Figure 3:
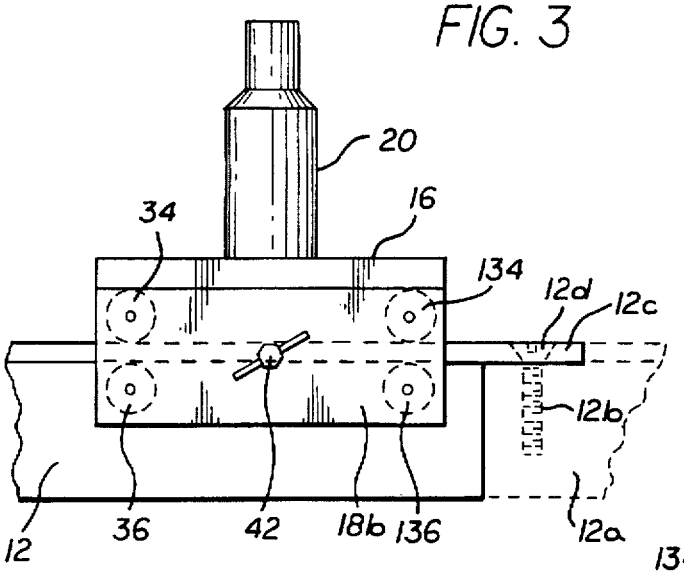
FIG. 3 is a side view of the movable boom mounting device.

FIG. 3 is a side view of the truck portion 14 mounted on the track portion 12. The side portion 18*b* of the truck portion 14 is visible from this view. The screw brake 42 is shown located at the same level as the top portion of the track portion 12. FIG. 3 also illustrates that the front wheels 34, 36 are matched by identical set of identically-attached wheels 134, 136 at the back end of the truck portion 14. Thus, as is seen in FIG. 3, the top wheels 34, 134 ride along the top portion of the track portion 12, and the bottom wheels 36, 136 ride along and engage the bottom surface of the top portion of the track portion 12.

FIG. 3 also illustrates the other end of the track portion 12, which has an overlapping top portion 12*c*. This extending top portion 12*c* is designed to engage an extending bottom portion 12*a* shown in FIG. 1 and shown in phantom in FIG. 3. The extending top portion 12*c* has at least one screw hole, preferably two, that lines up with the screw hole 12*b* located in the extending bottom portion 12*a*. In this way, a screw 12*d* will secure one track portion 12 to another track portion 12, so that a single track can be made to extend along the length of the entire stage. Two screws are used in the preferred embodiment because they provide more security in lining-up adjacent track portions.

Figure 4:
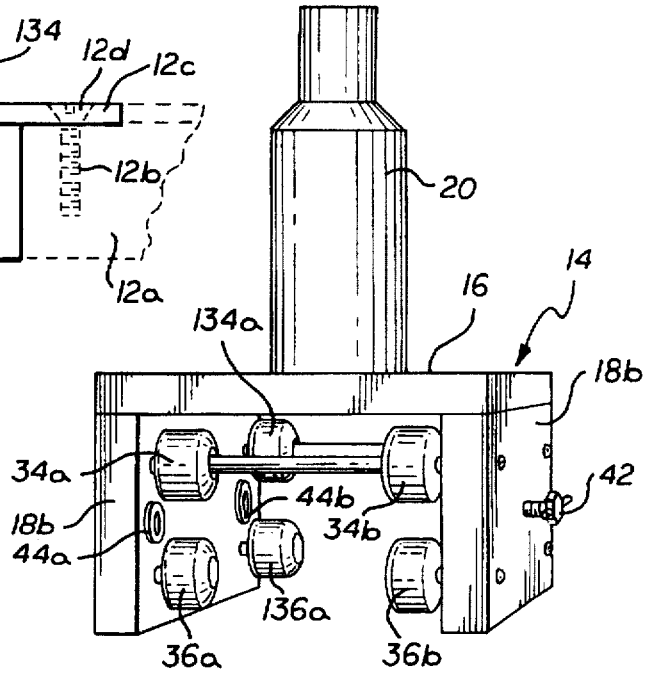
FIG. 4 is a side perspective view of the truck portion of the movable boom mounting device.

FIG. 4 is a perspective view of the truck portion 14. FIG. 4 illustrates the truck portion 14 as it is taken off of the track portion 12. FIG. 4 illustrates the location and mounting of the front wheels 34*a*, 34*b* and 36*a*, 36*b*, and rear wheels on one side 134*a*, 136*a*. FIG. 4 also illustrates the use of two spacers 44*a*, 44*b*, both of which are located between the top and bottom wheels to engage the side of the track portion 12. Spacers 44*a*, 44*b* ensure that the truck portion 14 is kept straight as it travels along the track portion 12.

Figure 5:
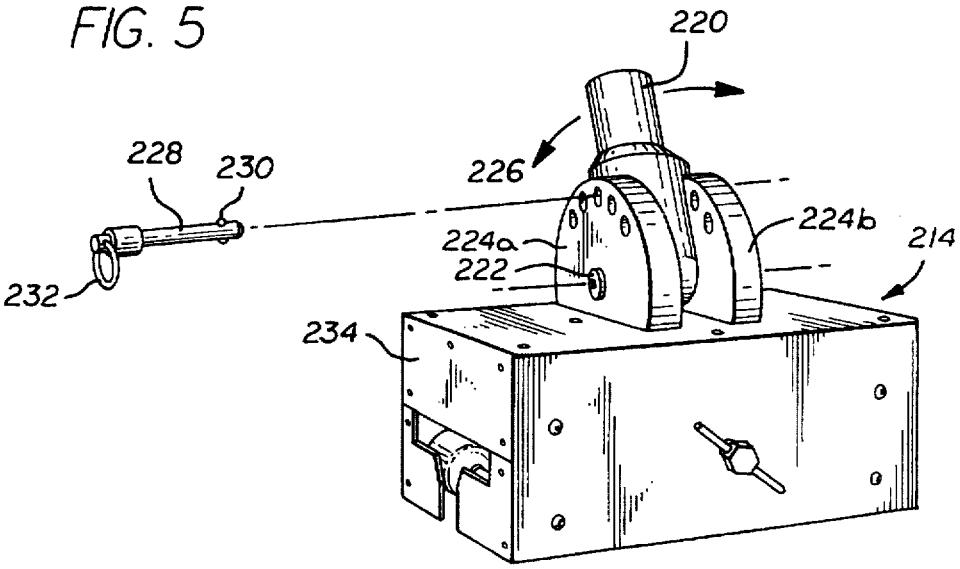
FIG. 5 is a perspective view of an alternative embodiment of the truck portion of the movable boom mounting device.

FIG. 5 illustrates an alternative embodiment of the truck portion 214. The truck portion 214 of the alternative embodiment of the present invention is similar to the construction of the truck portion 14, however it contains some additional features which will now be described. The major added feature of the truck portion 214 is that the boom mount is an adjustable boom mount 220 which pivots about an axle 222. The axle 222 is mounted between side plates 224*a* and 224*b*. Both side plates 224*a*, 224*b* contain holes 226 which line up with a hole in the boom mount 220. By lining up the hole in the boom mount 220 with one of the holes 226, a pin 228 may be inserted to lock the boom mount in to a specific position at an angle from the truck portion 214. This embodiment permits the boom mount 220 to be tilted more toward the stage below. This is particularly useful when the actors move toward the front of the stage, more directly underneath the catwalk and more directly below the microphone boom, requiring the microphone boom to be tilted more steeply downward. This is also useful in tilting the boom mount 220 back, as the actors move toward the back of the stage, farther away from the microphone boom.

The pin 228 preferably contains flexible protruding portions 230 to lock the pin in to place once it has been inserted through the holes 226 and the hole through the boom mount 220. The pin also preferably includes a ring or handle 232 to facilitate pulling the pin 228 out of the holes 226 and out of the boom mount 220 when it is desired to release the movable boom mount 220 and lock it in to a new angle with respect to the truck portion 214.

The alternative embodiment of the truck portion 214 also includes additional side panel covers 234 which cover the open sides of the truck portion 214 and enclose it around the "T" structure of the track portion 12. The side covers 234 keep out dust particles and other airborne particles from collecting and interfering with the transport mechanism of the wheels underneath the truck portion 214.

What is claimed is:

1. A movable microphone boom mounting device, comprising:

a single substantially flat, horizontal and elongated track; and a truck, said truck comprising:

top and side portions;

wheels mounted to said truck underneath said top portion and between said side portions, wherein all said wheels of said truck facilitate sliding movement of the truck along said single track, and wherein said single track supports substantially the entire load of the truck; and a microphone boom mount mounted to said top portion independent of a camera for attaching a slender microphone boom, said microphone boom mount comprising a base including a pivot which pivotably supports the slender microphone boom for positioning in a vertical plane and telescopically supports the slender microphone boom for varying the extension of a microphone in reference to the pivot.

2. The movable microphone boom mounting device of claim 1, further comprising:

vertical support members attached to the bottom of said track;

lateral support members attached to the side of said track.

3. The movable microphone boom mounting device of claim 1, wherein some of said wheels are mounted to engage the top surface of said track, and some of said wheels are mounted to engage the bottom surface of said track.

4. The movable microphone boom mounting device of claim 2, wherein some of said wheels are mounted to engage the top surface of said track, and some of said wheels are mounted to engage the bottom surface of said track.

5. The movable microphone boom mounting device of claim 1, wherein said microphone boom mount is attached to said truck by an axle, such that said microphone boom mount pivots about said axle, and wherein said truck additionally comprises a means for locking said microphone boom mount in any one of a plurality of positions about said axle.

6. The movable microphone boom mounting device of claim 1, wherein said truck additionally comprises covers that enclose said wheels.

7. A movable microphone boom mounting device, comprising:

an elongated track; and a truck, said truck comprising top and side portions;

wheels mounted to said truck underneath said top portion and between said side portions, wherein the wheels facilitate sliding movement of the truck along the track;

a microphone boom mount mounted to said top portion independent of a camera for attaching a slender microphone boom, said microphone boom mount comprising a base including a pivot which pivotably supports the slender microphone boom for positioning in a vertical plane and telescopically supports the slender microphone boom for varying the extension of a microphone in reference to the pivot; and vertical support members attached directly to the bottom of said track, said vertical support members being directly connected to the floor on which an operator of a microphone boom mounted to said movable microphone boom mounting device walks.

8. The movable microphone boom mounting device of claim 7, wherein some of said wheels are mounted to engage the top surface of said track, and some of said wheels are mounted to engage the bottom surface of said track.

9. The movable microphone boom mounting device of claim 8, wherein some of said wheels are mounted to engage the top surface of said track, and some of said wheels are mounted to engage the bottom surface of said track.

10. The movable microphone boom mounting device of claim 7, wherein said microphone boom mount is attached to said truck by an axle, such that said microphone boom mount pivots about said axle, and wherein said truck additionally comprises a means for locking said microphone boom mount in any one of a plurality of positions about said axle.

11. The movable microphone boom mounting device of claim 7, wherein said truck additionally comprises covers that enclose said wheels.

12. The movable microphone boom mounting device of claim 7, wherein said track comprises an extending bottom portion for engagement with an extending top portion of another track, such that two tracks can be connected to form one track.

13. The movable microphone boom mounting device of claim 12, wherein said extending bottom portion contains one or more screw holes.

14. A movable microphone boom mounting device, comprising:

an elongated track; and a truck, said truck comprising:

top and side portions;

wheels mounted to said truck underneath said top portion and between said side portions, wherein the wheels facilitate sliding movement of the truck alone the track, a microphone boom mount mounted to said top portion independent of a camera for attaching a slender microphone boom, said microphone boom mount comprising a base including a pivot which pivotably supports the slender microphone boom for positioning in a vertical plane and telescopically supports the slender microphone boom for varying the extension of a microphone in reference to the pivot; and lateral support members directly attached to the side of said track, said lateral support members being directly connected to a railing or similar structure that is in turn directly connected to the floor on which an operator of a microphone boom mounted to said movable microphone boom mounting device walks.

15. The movable microphone boom mounting device of claim 12, wherein some of said wheels are mounted to engage the top surface of said track, and some of said wheels are mounted to engage the bottom surface of said track.

16. The movable microphone boom mounting device of claim 13, wherein some of said wheels are mounted to engage the top surface of said track, and some of said wheels are mounted to engage the bottom surface of said track.

17. The movable microphone boom mounting device of claim 12, wherein said microphone boom mount is attached to said truck by an axle, such that said microphone boom mount pivots about said axle, and wherein said truck additionally comprises a means for locking said microphone boom mount in any one of a plurality of positions about said axle.

18. The movable microphone boom mounting device of claim 12, wherein said truck additionally comprises covers that enclose said wheels.

19. The movable microphone boom mounting device of claim 14, wherein said track comprises an extending bottom portion for engagement with an extending top portion of another track, such that two tracks can be connected to form one track.

20. The movable microphone boom mounting device of claim 19, wherein said extending bottom portion contains one or more screw holes.

21. A movable microphone boom mounting device as in claim 1, wherein:

said single track has a right edge and a left edge, the side portions of the truck comprises a right side portion and a left side portion, and at least one of said wheels is rotatably mounted to the right side portion of said truck to engage the bottom surface of said single track near its right edge, and at least one of said wheels is rotatably coupled to the left side portion of said truck to engage the bottom surface of said single track near its left edge.

22. A movable microphone boom mounting device as in claim 7, wherein:

said track has a right edge and a left edge, the side portions of the truck comprises a right side portion and a left side portion, and at least one of said wheels is rotatably mounted to the right side portion of said truck to engage the bottom surface of said track near its right edge, and at least one of said wheels is rotatably coupled to the left side portion of said truck to engage the bottom surface of said track near its left edge.

23. A movable microphone boom mounting device as in claim 14, wherein:

said track has a right edge and a left edge, the side portions of the truck comprises a right side portion and a left side portion, and at least one of said wheels is rotatably mounted to the right side portion of said truck to engage the bottom surface of said track near its right edge, and at least one of said wheels is rotatably coupled to the left side portion of said truck to engage the bottom surface of said track near its left edge.

* * * * *

UNITED STATES PATENT AND TRADEMARK OFFICE

CERTIFICATE OF CORRECTION

PATENT NO. : 5,757,943

DATED : May 26, 1998

INVENTOR(S) : Bruce Arledge, Jr.

It is certified that error appears in the above-identified patent and that said Letters Patent is hereby corrected as shown below:

Column 6, line 1, after "single" insert --,--.
Column 6, line 45, after "comprising" insert --:--.
Column 7, line 30, after replace "alone" with --along--.

Signed and Sealed this

Fourth Day of May, 1999

*Attest:*

*Attesting Officer*

Q. TODD DICKINSON

*Acting Commissioner of Patents and Trademarks*